United States Patent [19]

Eberly, Jr. et al.

[11] 4,404,094

[45] Sep. 13, 1983

[54] CATALYTIC REFORMING PROCESS

[75] Inventors: Paul E. Eberly, Jr.; William C. Baird, Jr., both of Baton Rouge, La.

[73] Assignee: Exxon Research and Engineering Co., Florham Park, N.J.

[21] Appl. No.: 394,718

[22] Filed: Jul. 2, 1982

[51] Int. Cl.[3] ..... C10G 35/085

[52] U.S. Cl. ..... 208/139

[58] Field of Search ..... 208/139

[56] References Cited

U.S. PATENT DOCUMENTS

| | | | |
|---|---|---|---|
| 4,201,661 | 5/1980 | Juquin et al. | 208/139 |
| 4,265,786 | 5/1981 | Eberly et al. | 208/139 |
| 4,370,224 | 1/1983 | Eberly et al. | 208/139 |

*Primary Examiner*—Curtis R. Davis

*Attorney, Agent, or Firm*—Llewellyn A. Proctor

[57] ABSTRACT

A catalyst pretreat procedure wherein a copper, selenium, or sulfur promoted platinum-iridium catalyst, preferably a platinum-iridium-selenium catalyst, is contacted with dry hydrogen at a temperature ranging from about 600° F.–1000° F., at a hydrogen partial pressure ranging from about 1–40 atmospheres at a flow rate sufficient to maintain the moisture level below about 500 parts per million parts by volume of gas in the exit gas stream, for a period of time ranging at least about 16 hours, preferably at least 16 hours to about 200 hours. Treatment of these catalysts at such conditions will provide a selectivity advantage ranging from about 1 to 2 (LV%) higher than a catalyst otherwise similar but not pretreated in this manner.

7 Claims, 3 Drawing Figures

REFORMING LOW SULFUR PARAFFINIC NAPHTHA WITH Pt-Ir-Se

FIGURE I

REFORMING LOW SULFUR PARAFFINIC NAPHTHA WITH Pt-Ir-Se

REFORMING LOW SULFUR PARAFFINIC NAPHTHA WITH Pt-Ir-Se

CYCLIC REFORMING OF LOW SULFUR PARAFFINIC FEED WITH Pt-Ir-Se

CATALYTIC REFORMING PROCESS

BACKGROUND OF THE INVENTION AND PRIOR ART

Figure 1:
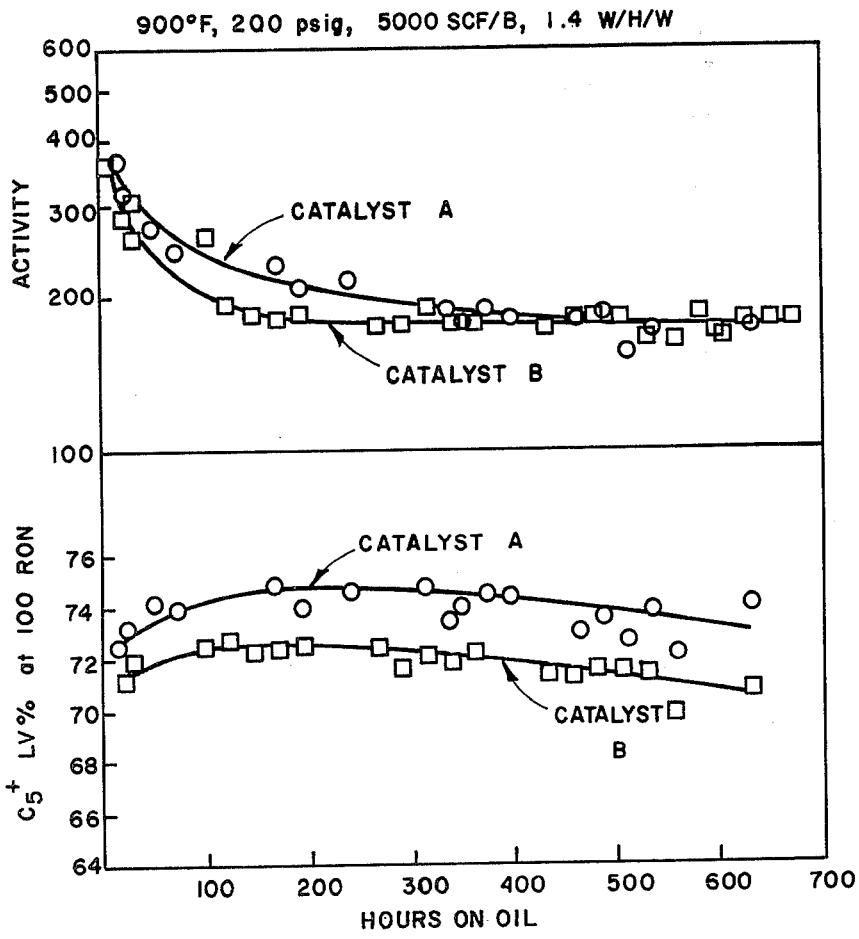

Catalytic reforming, or hydroforming, is a well established industrial process employed by the petroleum industry for improving the octane quality of naphthas or straight run gasolines. In reforming, a multi-functional catalyst is employed which contains a metal hydrogenation-dehydrogenation (hydrogen transfer) component, or components, substantially atomically dispersed upon the surface of a porous, inorganic oxide support, notably alumina. Noble metal catalysts, notably of the platinum type, are currently employed, reforming being defined as the total effect of the molecular changes, or hydrocarbon reactions, produced by dehydrogenation of cyclohexanes and dehydroisomerization of alkylcyclopentanes to yield aromatics; dehydrogenation of paraffins to yield olefins; dehydrocyclization of paraffins and olefins to yield aromatics; isomerization of n-paraffins; isomerization of alkylcycloparaffins to yield cyclohexanes; isomerization of substituted aromatics; and hydrocracking of paraffins which produces gas, and inevitably coke, the latter being deposited on the catalyst.

In a typical process, a series of reactors constitute the heart of the reforming unit. Each reforming reactor is generally provided with fixed beds of the catalyst which receive upflow or downflow feed, and each is provided with a preheater or interstage heater, because the predominant reactions which take place are endothermic. A naphtha feed, with hydrogen, or recycle gas, is concurrently passed through a preheat furnace and reactor, and then in sequence through subsequent heaters and reactors of the series. The product from the last reactor is separated into a liquid fraction, i.e., a $C_5+$ fraction, and a vaporous effluent. The latter is a gas rich in hydrogen, which usually contains small amounts of normally gaseous hydrocarbons, from which hydrogen is separated and recycled to the process to minimize coke production.

Platinum has been widely commercially used in recent years in the production of reforming catalysts, and platinum-on-alumina catalysts have been commercially employed in refineries for the last few decades. In recent years, polymetallic catalysts have been formed by the addition of other metallic components to platinum to promote and further improve the activity or selectivity, or both, of the basic platinum catalyst, e.g., iridium, rhenium, tin, and the like. Among the new generation bi-metallic catalysts, platinum-iridium catalysts possess superior activity for use in reforming operations as compared with platinum catalysts. These catalysts also possess good selectivity as contrasted with platinum catalysts, selectivity being defined as the ability of the catalyst to produce high yields of $C_5+$ liquid products with concurrent low production of normally gaseous hydrocarbons, i.e., methane and other gaseous hydrocarbons, and coke. More recently, both iridium and selenium, and iridium and sulfur, have been added to the basic platinum catalyst, the selectivity of these polymetallic catalysts being considerably improved as contrasted with the basic platinum, or platinum-iridium catalysts. (See, e.g., U.S. Pat. Nos. 4,151,115; 4,166,046; 4,169,043; 4,213,881; 4,282,086; and art cited therein).

In reforming operations, it is particularly important to have catalysts of high activity, and more particularly catalysts which are capable of producing high yields of $C_5+$ liquid of high octane. As a consequence, seemingly minor catalyst modifications which can increase $C_5+$ liquid yields of high octane have tremendous commercial potential. For example, it has been estimated that an improvement of 1 LV% in yield can mean as much as a 15 to 20 million dollar advantage used world wide by the reforming units of a major oil company.

It is, accordingly, the basic objective of the present invention to provide an improved platinum-iridium catalyst, especially a platinum-iridium-selenium catalyst, particularly a process of utilizing such catalyst in reforming; notably one providing superior $C_5+$ liquid yields of high octane gasoline vis-a-vis conventionally prepared platinum-iridium and platinum-iridium-selenium catalysts.

This object, and others are achieved in accordance with the present invention embodying a catalyst pretreat procedure, wherein a copper, selenium, or sulfur promoted platinum-iridium catalyst, preferably a platinum-iridium-selenium catalyst, is contacted with dry hydrogen or a dry hydrogen-containing gas, at a temperature ranging from about 600° F. to about 1000° F., preferably from about 750° F. to about 900° F., at a hydrogen partial pressure ranging from about 1 atmosphere to about 40 atmospheres, preferably from about 5 atmospheres to about 30 atmospheres, at a flow rate sufficient to maintain the moisture level below about 500 parts, preferably from about 0 parts to about 200 parts, and more preferably from about 10 parts to about 200 parts per million parts by volume of gas in the exit gas stream. The contact between the dry hydrogen and catalyst is continued for a period of time ranging at least about 16 hours, preferably at least 16 hours to about 200 hours, and more preferably from about 16 hours to about 48 hours. A platinum-iridium-selenium catalyst so treated with dry hydrogen, or hydrogen-containing gas which contains less than 200 ppm moisture, preferably from about 5 ppm to about 50 ppm, or more preferably from about 5 ppm to about 10 ppm water at such conditions, will provide a selectivity advantage ranging from about 1 to 2 liquid volume percent (LV%) higher than a catalyst otherwise similar but not pretreated in this manner.

The reasons for the effectiveness of this treatment in increasing the $C_5+$ liquid yield of high octane gasoline or naphtha is not clearly understood. Whereas it has long been considered that the platinum and iridium metal components of the catalyst need to be in the zero valent state for best performance, simple reduction is not an explanation since the oxides of both platinum and iridium have very low heats of formation and are easily reduced at very mild conditions. However, the dispersion of the reduced metals, their distribution throughout the extrudate, or degree of alloying may be strongly affected by the amount of water present. The presence of water also affects the degree of hydration of the surface, surface acidity, and dispersion of the chlorine atoms. In any regard, for whatever reason the extensive treatment of platinum-iridium-selenium catalysts in this manner results in a significant activity increase and a significantly large increase in yield.

Catalysts useful in accordance with this invention are platinum-iridium catalysts further modified by the addition of copper, sulfur, and selenium; preferably selenium. Suitably, the selenium or sulfur components are added during impregnation in the form of selenous of sulfurous acid or selenic or sulfuric acid to the impregnating mixture. Alternately, the catalysts containing platinum and iridium can be exposed to hydrogen sulfide or hydrogen selenide under controlled conditions. The platinum, iridium, copper and other promoters are added in concentration ranging about 0.01 to 3 percent, preferably from about 0.02 to about 1 percent, based on the weight of the catalyst.

The metal hydrogenation components can be composited or intimately associated with the porous inorganic oxide support or carrier by various techniques known to the art such as ion-exchange, coprecipitation with the alumina in the sol or gel form, and the like. For example, the catalyst composite can be formed by adding together suitable reagents such as salts of platinum, iridium, and selenium, or copper, and ammonium hydroxide or ammonium carbonate, and a salt of alumunim such as aluminum chloride or aluminum sulfate to form aluminum hydroxide. The aluminum hydroxide containing the salts of platinum can then be heated, dried, formed into pills, pellets, tablets, or the like or extruded, and then calcined in the absence of oxygen, e.g., in nitrogen or other non-agglomerating atmosphere. The metal components can also be added to the catalyst by impregnation, typically via an "incipient wetness" technique which requires a minimum of solution so that the total solution is absorbed, initially or after some evaporation.

It is generally preferred, however, to deposite the platinum metal, platinum and iridium metals, and other metals or non-metals used as promoters, on a previously pilled, pelleted, beaded, extruded or sieved particular support material by the impregnation method. Pursuant to the impregnation method, porous refractory inorganic oxides in dry or solvated state are contacted, either alone or admixed, or otherwise incorporated with a metal or metals-containing solution, or solutions, and thereby impregnated by either the "incipient wetness" technique, or a technique embodying absorption from a dilute or concentrated solution, or solutions, with subsequent filtration or evaporation to effect total uptake of the metallic components.

The impregnation solutions of the noble metal compound, and metals or other compounds used as promoters, are prepared by dissolving the compounds, or salts, in water or any other inorganic or organic solvents. The concentration of the metallic components range from about 0.01 to 5 percent, preferably from about 0.05 to 1 percent, based on the weight of solution. The pH of the impregnation solution should be controlled to less than about 4, preferably less than 3, by the addition of a suitable inorganic or organic acid. By controlling the pH within these ranges, the components can be effectively dispersed into the inner part of the catalyst. Generally, it is preferred to use a halogen-acid aqueous solution of the noble metals.

In accordance with this invention, the selenous and sulfurous acid or selenic and sulfuric acid components, or both, are incorporated into the catalyst at the time of its formation and preferably selenium is incorporated by impregnation of a solution of a soluble salt, acid or compound of selenium into the carrier. This can be carried out simultaneously with, prior to, or following the impregnation of the other metal components into the carrier. Selenium, in accordance with this invention, can be added to the carrier from a solution which contains both the salt, acid or compound of selenium, and the noble metal components. Suitably, the salts or compounds are dissolved in a suitable solvent, preferably water, to form a solution, or each is separately dissolved in a solution, the solutions admixed and the admixed solution used for impregnation of the carrier.

In one preferred embodiment of the present invention a carrier can be impregnated with an aqueous halogen-acid solution of the platinum metal, iridium or other compounds, if any, followed by evaporation or filtration and then drying or calcination, or both, and then the metals impregnated catalysts can be further impregnated with a solution containing a dissolved acid, salt or compound of selenium followed by evaporation or filtration and then drying, whereby the selenium component can be dispersed substantially uniformly to the inner part of the catalyst To enhance catalyst performance, it is also required to add a halogen component. Fluorine and chlorine are preferred halogen components. The halogen is contained on the catalyst within the range of 0.1 to 3 percent, preferably within the range of about 0.3 to 2 percent, based on the weight of the catalyst. When using chlorine as a halogen component, it is contained on the catalyst within the range of about 0.2 to 2 percent, preferably within the range of about 0.5 to 1.5 percent; based on the weight of the catalyst. The introduction of halogen into catalyst can be carried out by any method and at any time of the catalyst preparation, for example, prior to, following or simultaneously with the impregnation of the platinum metal, iridium, and selenium or copper and sulfur components. In the usual operation, the halogen component is introduced simultaneously with the incorporation of the platinum metal component. It can also be introduced by contacting a carrier material in a vapor phase or liquid phase with a halogen compound such as hydrogen fluoride, hydrogen chloride, ammonium chloride, or the like.

The catalyst is dried by heating at a temperature above about 80° F., preferably between about 105° F. and 300° F., in the presence of nitrogen or oxygen, or both, in an air stream or under vacuum. The catalyst need not be calcined but if calcined at temperatures in excess of 600° F., it is generally preferred to calcine in atmospheres containing low partial pressures of oxygen or still more preferably in a non-reactive or inert gas such as $N_2$.

The feed or charge stock can be a virgin naphtha, cracked naphtha, a Fischer-Tropsch naphtha, or the like. Typical feeds are those hydrocarbons containing from about 5 to 12 carbon atoms, or more preferably from about 6 to about 9 carbon atoms. Naphthas, or petroleum fractions boiling within the range of from about 80° F. to about 450° F., and preferably from about 125° F. to about 375° F., contain hydrocarbons of carbon numbers within these ranges. Typical fractions thus usually contain from about 20 to about 80 vol.% paraffins, both normal and branched, which fall in the range of about $C_5$ to $C_{12}$, from about 10 to 80 vol.% of naphthenes falling within the range of from about $C_6$ to $C_{12}$, and from 5 through 20 vol.% of the desirable aromatics falling within the range of from about $C_6$ to $C_{12}$.

The reforming runs are initiated by adjusting the hydrogen and feed rates, and the temperature and pressure to operating conditions. The run is continued at optimum reforming conditions by adjustment of the major process variables, within the ranges described below.

| Major Operating Variables | Typical Process Conditions | Preferred Process Conditions |
|---|---|---|
| Pressure, Psig | 50–750 | 100–300 |
| Reactor Temp., °F. | 750–1100 | 850–1000 |
| Gas Rate, SCF/B (Incl. Recycle Gas) | 1500–10,000 | 2000–7000 |
| Feed Rate, W/W/Hr. | 0.5–10 | 1–3 |

The invention will be more fully understood by reference to the following demonstrations and examples which present comparative data illustrating its more salient features.

EXAMPLE 1

The reduction of a previously prepared, dried, platinum-iridium-selenium on alumina catalyst is described by reference to Table I; this catalyst being referred to as Catalyst A.

TABLE I

Reduction Schedule
0.3% Pt + 0.3% Ir + 0.03% Se + 0.03% S on $Al_2O_3$
$H_2$ @ 6.3 Atmospheres and 17.2 SCF/lb. Cat./Hr.

| Time, Hr. | Temp., °F. |
|---|---|
| 0–27 | 370 |
| 27–42 | 370–544 |
| 42–44 | 544–601 |
| 44–64 | 601 |
| 64–67 | 601–644 |
| 67–70 | 644 |
| 70–72 | 644–650 |
| 72–87 | 650 |
| 87–91 | 650–744 |
| 91–118 | 744–810 |
| 118–134 | 810–830 |
| 134–206 | 830–872 |
| 106–231 | 872–750 |

The time temperature sequence below 600° F. is not critical. In this region the bulk water is removed. The use of hydrogen below 600° F. is not critical. In fact, at temperatures below 600° F., a non reducing gas such as air, $N_2$, or oxygen, may be used and in certain cases is preferred.

A second portion of the catalyst was reduced at 100 psig and 17.2 SCF/lb. cat/hr. for a time period of 16 hours. This catalyst is referred to as Catalyst B. Both Catalysts A and B were used for the reforming of a low sulfur paraffinic naphtha the properties of which are shown in Table I-A.

TABLE I-A

| ASTM Distillation, °F. | |
|---|---|
| Initial | 145 |
| 10 | 181 |
| 20 | 204 |
| 30 | 222 |
| 40 | 240 |
| 50 | 258 |
| 60 | 275 |
| 70 | 293 |
| 80 | 313 |
| 90 | 334 |
| Final B.P. | 363 |
| Octane No., RON Clear | 34.8 |
| Gravity, °API | 59.7 |
| Sulfur, Wt. ppm | 0.5 |
| Water, Wt. ppm | 20.0 |
| Chlorine, Wt. ppm | 1.0 |
| Analysis, Vol. Percent | |
| Paraffins | 69.51 |
| Naphthenes | 18.41 |

TABLE I-A-continued

| | |
|---|---|
| Aromatics | 12.08 |

The reforming runs were carried out with this feed to produce an approximately 100 ROM liquid product. Results are given in the attached FIG. 1. As seen, Catalyst A of this invention gives on the average an incremental 2 vol.% liquid yield increase throughout the run. Also, up to 500 hours, Catalyst A has greater catalyst activity than the conventionally reduced catalyst.

EXAMPLE 2

In a second example a 0.3 Pt-0.3 Ir-0.05 Se catalyst was pretreated according to the following procedure. This catalyst is characterized as Catalyst C. A companion Catalyst D was simply reduced at 750° F. for 16 hours.

Reduction Schedule
0.3 Pt-0.3 Ir-0.05% Se
15 Atmospheres

| Time, Hr. | Gas | Rate | Temp., °F. |
|---|---|---|---|
| 0 | $N_2$ | 0.6 1/min/g | 350 |
| 3.5 | " | " | 386 |
| 3.8 | " | " | 410 |
| 4.6 | " | " | 436 |
| 5.6 | " | " | 465 |
| 6.1 | " | | 500 |
| 6.6 | " | | 537 |
| 7.6 | " | | 556 |
| 8.1 | " | | 568 |
| 8.6 | " | | 593 |
| 9.1 | | | 600 |
| 10.6 | | | 600 |
| 18.1 | | | 600 |
| 21.6 | | | 600 |
| 21.6 | $H_2$ | 0.5 1/min/g | 600 |
| 23.8 | " | " | 626 |
| 24.0 | | | 653 |
| 30.0 | | | 689 |
| 33.0 | | | 725 |
| 35.1 | | | 761 |
| 42.6 | | | 788 |
| 47.6 | | | 824 |
| 55.1 | | | 856 |
| 56.4 | | | 875 |
| 60.7 | | | 885 |
| 62.0 | | | 894 |
| 65.3 | | | 898 |
| 79.3 | | | 900 |

Figure 2:
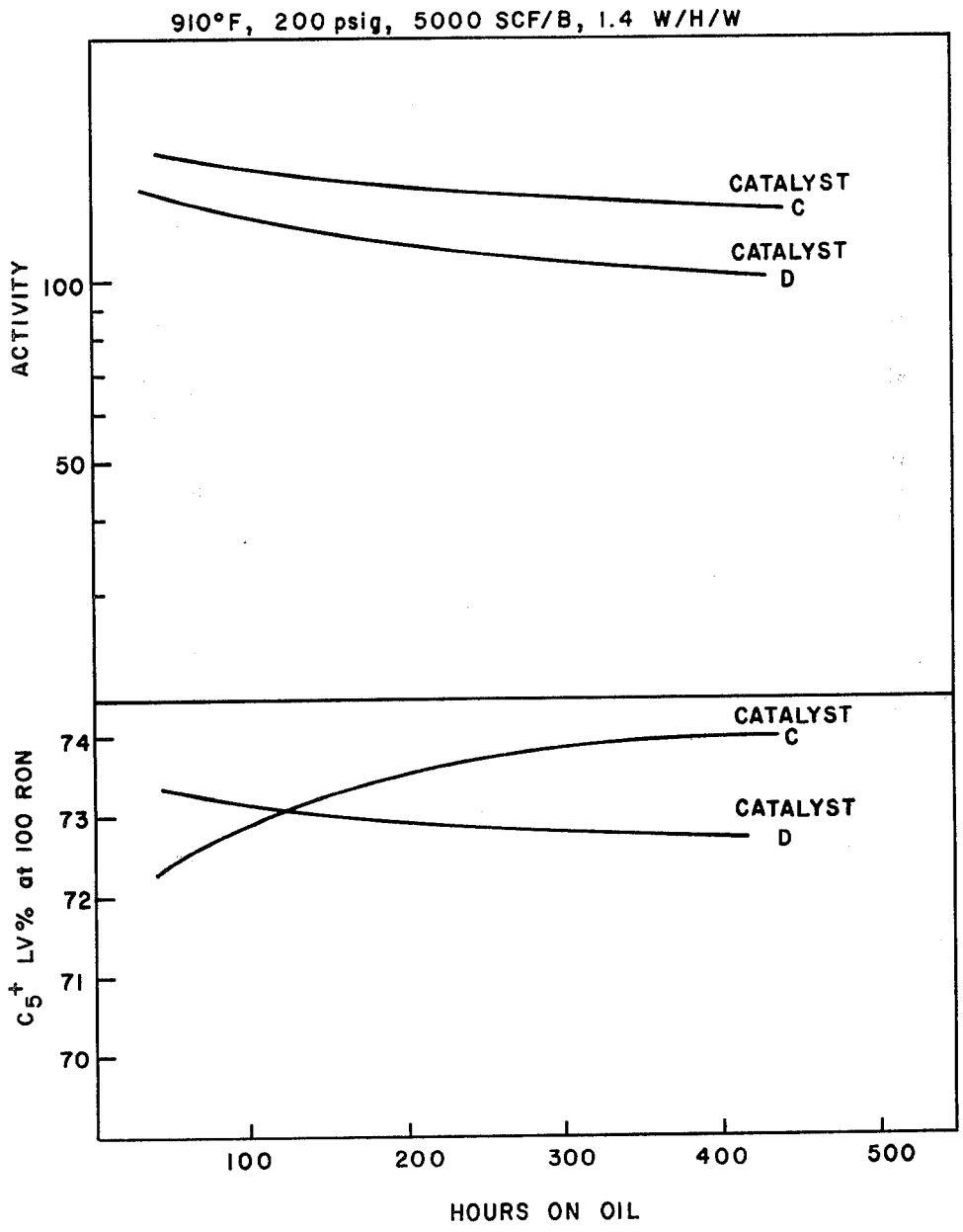

In the case of Catalyst C the reduction period was at about 900° F. for a period of 17 hours. Both Catalyst C and D were used to reform a low sulfur paraffinic naphtha similar to, though not identical with that described in Table I-A. (There was no material difference between the two feeds.) FIG. 2 illustrates the relative yield and activity performance. Catalyst C prereduced according to the procedure of this invention provides a 30% activity credit and a 1.3 LV% yield credit relative to Catalyst D.

EXAMPLE 3

Figure 3:
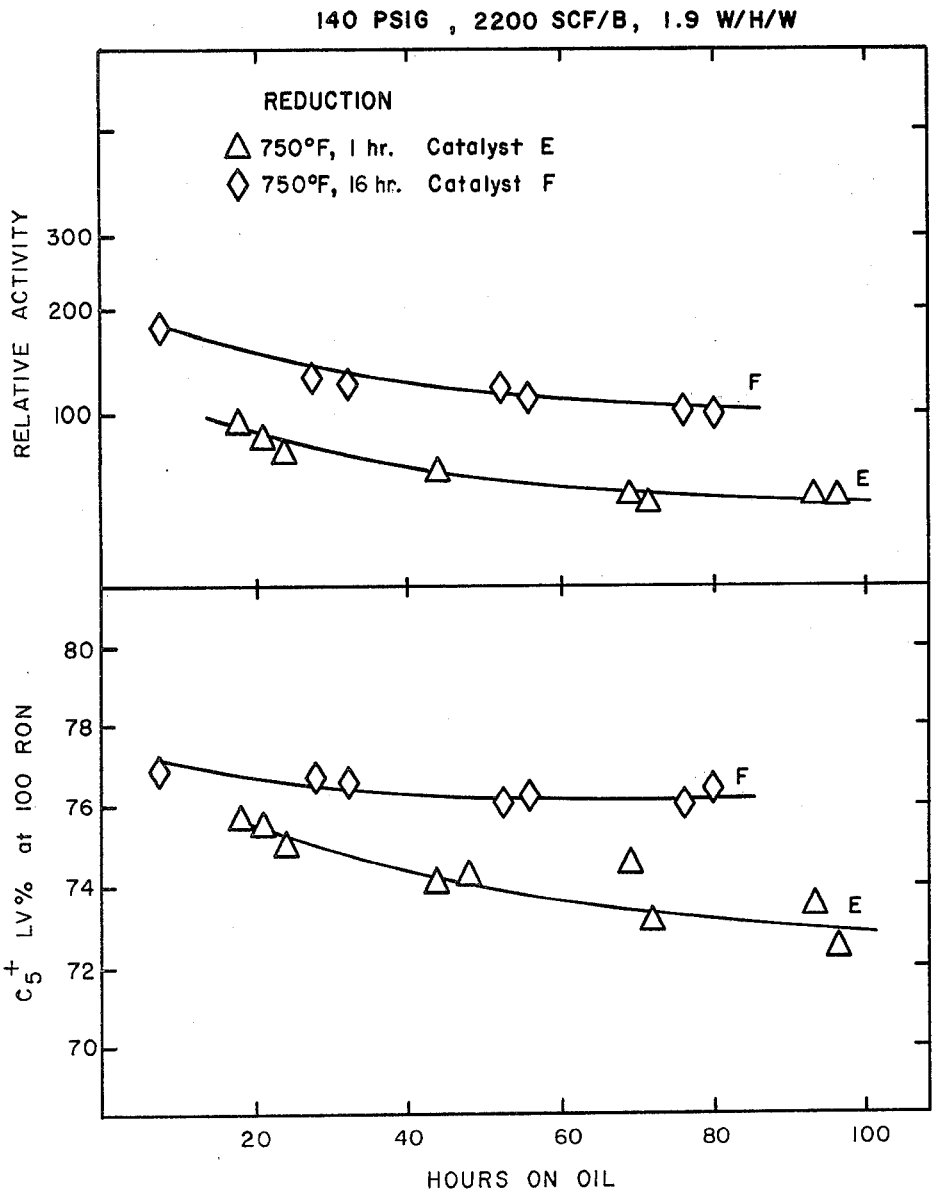

A sample of 0.3 Pt-0.3 Ir-0.05 Se was reduced at 750° F. for 1 hour (Catalyst E). A second sample of the same catalyst was reduced at 750° F. for 16 hours (Catalyst F). Both catalyst were used to reform at cyclic severity a paraffinic naphtha not materially different from that described in Table I-A. FIG. 3 shows that Catalyst F reduced under the conditions of this invention provided significant yield and activity credits.

It is apparent that various modifications and changes can be made without departing the spirit and scope of the present invention.

Having described the invention, what is claimed is:

1. In a process for reforming a hydrocarbon feed at reforming conditions which comprises contacting said feed with a catalyst which comprises a platinum component, an iridium component, a component selected from the group consisting of copper, selenium and sulfur, and a halogen component, the improvement wherein the catalyst is contacted with dry hydrogen or a dry hydrogen-containing gas at temperatures ranging from about 600° F. to about 1000° F., at a hydrogen partial pressure ranging from about 1 atmosphere to about 40 atmospheres, at a flow rate sufficient to maintain the moisture level in the exit gas below about 500 ppm, and maintaining said contact for a period ranging at least 16 hours to increase the activity or selectivity, or both, as contrasted with a catalyst composition otherwise similar except that it has not been so-treated.

2. The process of claim 1 wherein the temperature ranges from about 750° F. to about 900° F.

3. The process of claim 1 wherein the hydrogen partial pressure ranges from about 5 atmospheres to about 30 atmospheres.

4. The process of claim 1 wherein the rate is sufficient to maintain the moisture level in the exit gas at about 10 ppm to about 200 ppm.

5. The process of claim 1 wherein the temperature ranges from about 750° F. to about 900° F., the hydrogen partial pressure ranges from about 5 atmospheres to about 30 atmospheres, and the rate is sufficient to maintain the moisture level in the exit gas at about 10 ppm to about 200 ppm.

6. The process of claims 2, 3, 4, and 5 wherein the contact between the dry hydrogen or dry hydrogen-containing gas is continued for a period of from about 16 hours to about 200 hours.

7. The process of claim 1 wherein the catalyst is a platinum-iridium-selenium catalyst.

* * * * *